US005100307A

United States Patent [19]

Arita et al.

[11] Patent Number: 5,100,307

[45] Date of Patent: Mar. 31, 1992

[54] SCROLL-TYPE FLUID MACHINE WITH A PLURALITY OF DISCHARGE PORTS

[75] Inventors: Masumi Arita; Mitsuhiro Nishida, both of Fukuoka, Japan

[73] Assignee: Mitsubishi Denki K.K., Tokyo, Japan

[21] Appl. No.: 505,613

[22] Filed: Apr. 6, 1990

[30] Foreign Application Priority Data

Apr. 11, 1989 [JP] Japan ..... 1-92529

[51] Int. Cl.[5] ..... F04C 18/04; F04C 29/02

[52] U.S. Cl. ..... 418/15; 418/55.1; 418/55.6; 418/188

[58] Field of Search ..... 418/15, 55.1, 55.2, 418/55.5, 55.6, 188

[56] References Cited

U.S. PATENT DOCUMENTS 4,314,796 2/1982 Terauchi ..... 418/55.6
4,842,499 6/1989 Nishida et al. ..... 418/188
4,927,339 5/1990 Riffe et al. ..... 418/188

FOREIGN PATENT DOCUMENTS 63-306291 12/1988 Japan ..... 418/15

*Primary Examiner*—John J. Vrablik
*Attorney, Agent, or Firm*—Sughrue, Mion, Zinn, Macpeak & Seas

[57] ABSTRACT

A scroll-type fluid machine has a pair of interfitting scrolls. Each scroll has a discharge port at its center which communicates with a discharge chamber via a discharge passage formed in the scroll. A check valve is disposed in each discharge port.

2 Claims, 2 Drawing Sheets

SCROLL-TYPE FLUID MACHINE WITH A PLURALITY OF DISCHARGE PORTS

BACKGROUND OF THE INVENTION

This invention relates to a scroll-type fluid machine. More particularly but not exclusively, it relates to a scroll-type vacuum pump of the type having two rotating scrolls.

A scroll-type fluid machine is a positive displacement machine having two interfitting elements usually referred to as scrolls. Each scroll includes a disk-shaped end plate and a thin-walled member, referred to as a spiral wrap, which projects perpendicularly from one surface of the end plate and curves outwards from the center of the end plate in the shape of an involute or other type of spiral. The two scrolls are disposed with the end plates parallel and the spiral wraps interfitting with one another so that they are in line contact at a plurality of locations. The surfaces of the end plates and the spiral wraps define a plurality of spiral compression chambers between the points of contact between the spiral wraps. If the scrolls are rotated with respect to one another in the proper direction while maintaining the line contact between the spiral wraps, the compression chambers are gradually moved towards the centers of the scrolls with an accompanying decrease in volume. A working fluid is introduced into the compression chambers via a suction port formed in the outer periphery of one of the scrolls and is then removed at a higher pressure from a discharge port formed in the center of the end plate of one of the scrolls.

In some scroll-type fluid machines which are employed as vacuum pumps, a check valve is disposed inside the discharge port to prevent gas and fluids from being sucked into the compression chamber from the outside of the pump through the discharge port. Such a check valve increases the degree of vacuum which can be produced by the pump. On the other hand, it has the disadvantage that the resistance of the check valve to fluid flow decreases the pumping efficiency of the pump.

SUMMARY OF THE INVENTION

Accordingly, it is an object of the present invention to provide a scroll-type fluid machine which can produce a high degree of vacuum when used as a vacuum pump and which also has a high pumping efficiency.

A scroll-type fluid machine according to the present invention has first and second scrolls which interfit to define one or more compression chambers. Each scroll also has a discharge port at its center which communicates between one of the compression chambers and the outside of the scroll. A check valve is disposed in each discharge port to prevent the reverse flow of fluid into the compression chambers.

The provision of a discharge port in each scroll decreases the total flow resistance through the discharge ports compared to a fluid machine having only a single discharge port, so the pumping efficiency of the fluid machine is increased.

In a preferred embodiment, the fluid machine is of the type having a drive scroll and a driven scroll which are rotatably supported for rotation about eccentric axes, but the present invention can also be in the form of a fluid machine having a moving scroll and a stationary scroll.

DESCRIPTION OF THE PREFERRED EMBODIMENT

Figure 1:
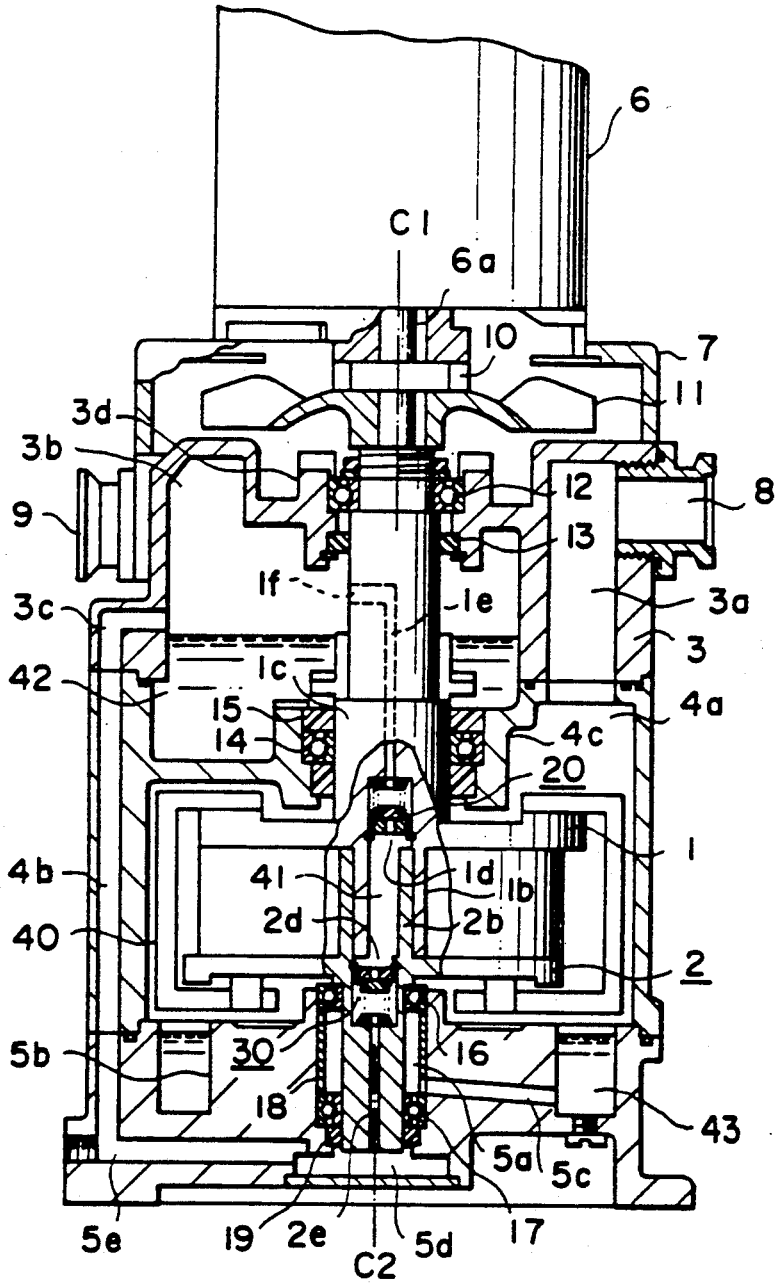
FIG. 1 is a vertical cross-sectional view of an embodiment of a scroll-type fluid machine according to the present invention.

A preferred embodiment of a scroll-type fluid machine according to the present invention will now be described while referring to the accompanying drawings. The illustrated embodiment is in the form of a vacuum pump, but the present invention is not restricted to use as a pump. As shown in FIG. 1, which is a vertical cross-sectional view, this embodiment includes a hollow upper casing 3, a hollow lower casing 4, and a base 5 which are mounted one atop the other. A hermetic seal is formed between the bottom surface of the upper casing 3 and the top surface of the lower casing 4 by an 0- ring which is mounted in a groove formed in the lower casing 4. Similarly, a hermetic seal is formed between the bottom surface of the lower casing 4 and the top surface of the base 5 by an 0-ring which is mounted in a groove formed in the top surface of the base 5.

Figure 2:
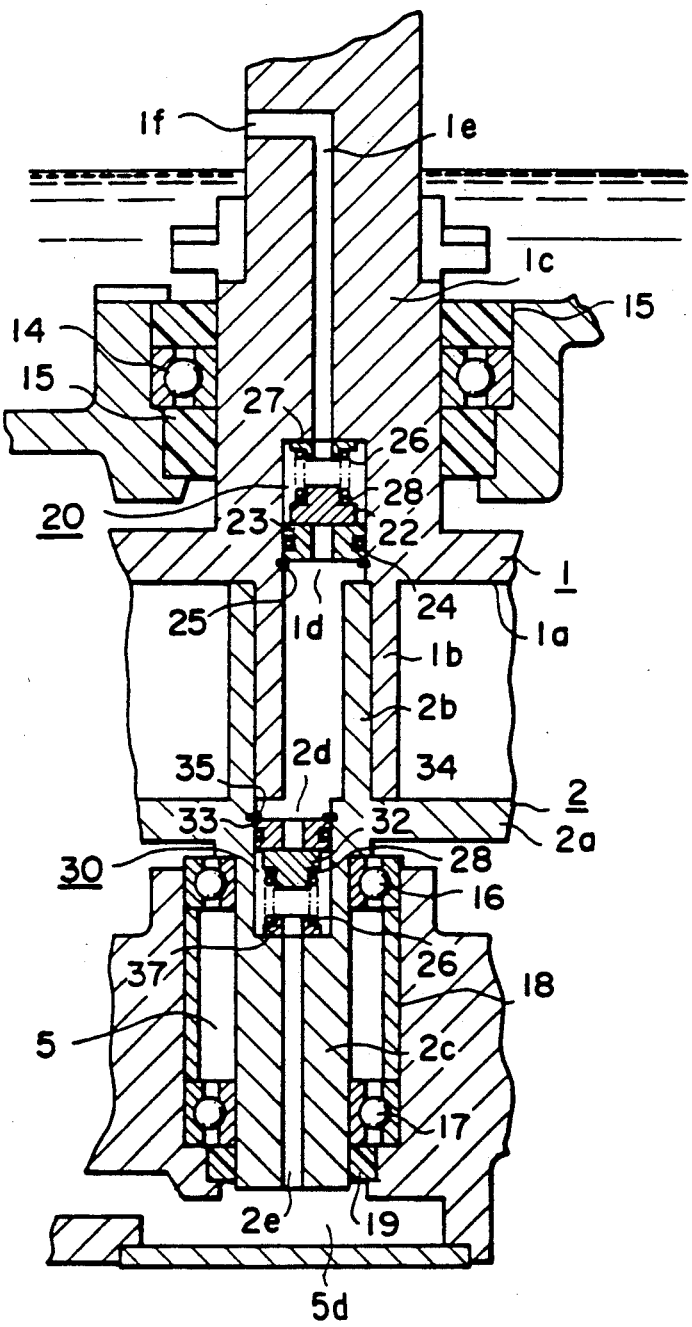
FIG. 2 is an enlarged cross-sectional view of the central portion of the embodiment of FIG. 1.

The inside of the lower casing 4 defines a scroll chamber 4*a* in which a drive scroll 1 and a driven scroll 2 are housed. As best shown in FIG. 2, which is an enlarged cross-sectional view of the central portion of this embodiment, the drive scroll 1 includes a disk-shaped base plate 1*a*, a spiral wrap 1*b* which extends perpendicularly from one surface of the base plate 1*a*, and a drive shaft 1*c* which extends perpendicularly from the opposite surface of the base plate 1*a*. Similarly, the driven scroll 2 includes a disk-shaped base plate 2*a*, a spiral wrap 2*b*, and a shaft 2*c*. The two base plates 1*a* and 2*a* are disposed parallel to one another, and the two spiral wraps 1*b* and 2*b* are interfit so as to define one or more compression chambers 41 therebetween. An unillustrated suction port can be formed in the outer periphery of one of the scrolls to allow fluid to enter the compression chambers 41 A discharge port 1*d* is formed at the center of the base plate la of the drive scroll 1, while another discharge port 2*d* is formed at the center of the base plate 2*a* of the driven scroll 2. A first check valve assembly 20 is disposed inside the discharge port 1*d* of the drive scroll 1, while an identical second check valve assembly 30 is provided in the discharge port 2*d* of the driven scroll 2.

The drive shaft 1*c* of the drive scroll 1 extends from the scroll chamber 4*a* into the upper casing 3 through a hollow boss 4*c* of the lower casing 4. The lower portion of the drive shaft 1*c* is rotatably supported by a lower bearing 14 which is mounted inside the boss 4*c*. Oil seals 15 are disposed inside the boss 4*c* on either side of the lower bearing 14.

The upper end of the drive shaft 1*c* is rotatably supported by an upper journal bearing 12 having an outer race which is secured to the inside of a hollow boss 3*d* formed at the center of the upper surface of the upper casing 3. An oil seal 13 is disposed around the drive shaft 1*c* on the underside of the upper surface of the upper casing 3.

An electric motor 6 is mounted atop the upper casing 3 by means of a motor support 7. The motor 6 has an output shaft 6*a* which is connected to the drive shaft 1*c* of the drive scroll 1 by a coupling 10. A cooling fan 11 for cooling the motor 6 is mounted on the drive shaft 1*c* just below the coupling 10.

The upper portion of the upper casing 3 is equipped with a suction port 8 and a discharge port 9. The suction port 8 is connected with the inside of the scroll chamber 4*a* by a suction passage 3*a* which is formed inside the upper casing 3 and is separated from the other portions of the inside of the upper casing 3. The remainder of the inside of the upper casing 3 defines a discharge chamber 3*b* which communicates with the discharge port 9. The lower portion of the discharge chamber 3*b* is filled with lubricating oil 42. The discharge port 1*d* of the drive scroll 1 is connected with the discharge chamber 3*b* by an axial discharge passage 1*e* which extends axially through the drive shaft 1*c* from the discharge port 1*d* of the drive scroll 1 and by a plurality of radial passages 1*f* which extend radially outwards from the upper end of the axial discharge passage 1*e* to the surface of the drive shaft 1*c* above the level of the lubricating oil 42. The lower journal bearing 14 for the drive shaft 1*c* is immersed in the lubricating oil 42. The oil 42 is prevented from leaking past the lower bearing 14 and into the scroll chamber 4*a* by the oil seals 15.

When the illustrated embodiment is to be used as a vacuum pump, the suction port 8 can be connected to an unillustrated chamber which is to be evacuated.

The shaft 2*c* of the driven scroll 2 is rotatably supported by journal bearings 16 and 17 which are mounted inside a cylindrical bearing chamber 5*a* formed at the center of the base 5. The two bearings 16 and 17 are separated by a spacer 18, and the lower bearing 17 is adjoined by an oil seal 19. The axis C2 of the shaft 2*c* of the driven scroll 2 is eccentric with respect to the axis C1 of the drive shaft 1*c* of the drive scroll 1. The rotation of the drive scroll 1 is transmitted to the driven scroll 2 by means of a conventional Oldham coupling 40.

An oil sump 5*b* for the lubricating oil 43 is formed in the base 5. Oil 43 which accumulates inside the sump 5*b* is supplied to the inside of the bearing chamber 5*a* by an oil supply passage 5*c* which extends between the sump 5*b* and the bearing chamber 5*a*. A discharge chamber 5*d* is formed in the base 5 beneath the bearing chamber 5*a*. The discharge port 2*d* of the driven scroll 2 is connected with discharge chamber 5*d* by a discharge passage 2*e* which extends axially through the shaft 2*c* of the driven scroll 2 from the discharge port 2*d* to the end surface of the shaft 2*c*. A discharge passage 5*e* extends inside the base 5 between discharge chamber 5*d* and the upper surface of the base 5. The upper end of discharge passage 5*e* is connected to the lower end of another discharge passage 4*b* which is formed in the outer periphery of the lower casing 4. The upper end of discharge passage 4*b* is connected to the lower end of a discharge passage 3*c* which is formed in the outer periphery of the upper casing 3. The upper end of this discharge passage 3*c* opens onto discharge chamber 3*b* above the level of the lubricating oil 42.

FIG. 2 illustrates the check valve assemblies 20 and 30 in greater detail. The first and second check valve assemblies are identical in structure, and elements of the second check valve assembly 30 which correspond to elements in the first check assembly 20 have a reference numeral which is 10 higher than for the first check valve assembly 20. Therefore, only the first check valve assembly 20 for the drive scroll 1 will be described.

The first check valve assembly 20 includes a valve 22 which is supported by an annular valve seat 23. The valve seat 23 is supported by a snap ring 25 which fits into a groove formed in the wall of the discharge chamber 1*d*. Fluids are prevented from leaking past the outer periphery of the valve seat 23 by an O-ring 24 which is inserted into a circumferential groove in the outer surface of the valve seat 23.

The valve 22 is biased against the valve seat 23 in a closed position by a helical spring 26. The upper end of the spring 26 fits over a hollow, flanged spring seat 27 which is disposed at the upper end of the discharge port 1*d*, while the lower end of the spring 26 rests against a washer 28 which fits over a boss of the valve seat 22.

Any type of check valve can be employed in a fluid machine according to the present invention in order to prevent reverse flow through the discharge ports 1*d* and 2*d*, and the check valves need not be disposed inside the discharge ports. However, the illustrated arrangement in which the check valve assemblies are housed inside the discharge ports has the advantage of being extremely compact and of minimizing the circumferential forces acting on the check valve assemblies.

When the motor 6 is operated, the drive scroll 1 is rotated by the motor 6 about axis C1, while the driven scroll 2 is rotated on its shaft 2*c* about axis C2 by the rotational force transmitted to the driven scroll 2 by the Oldham coupling 40. As a result, the two scrolls 1 and 2 rotate in synchrony about eccentric axes C1 and C2. As the scrolls rotate, the compression chambers 41 which are formed between the spiral wraps of the two scrolls are gradually moved from the radially outer portions to the radially inner portions of the scrolls with an accompanying decrease in volume, and pumping action is performed. The pumping action sucks gas through the suction port 8 and suction passage 3*a* into the scroll chamber 4*a*, from where the gas is sucked into the compression chambers 41 through the unillustrated suction port. The gas is then compressed by the rotation of the scrolls and gradually shifted to the center of the scrolls. When the compressed gas in the centermost compression chamber 41 reaches a prescribed pressure, it forces open valves 22 and 32 against the force of the biasing springs 26 and 36 and flows out of the discharge ports 1*d* and 2*d* through the valves. Compressed gas which passes through valve 22 flows through passages 1*e* and 1*f* into discharge chamber 3*b*. Compressed gas which passes through valve 32 flows through discharge passage 2*e* into discharge chamber 5*d*, and from there it flows through discharge passages 5*e*, 4*b*, and 3*c* into discharge chamber 3*b*. The compressed gas in discharge chamber 3*b* is then discharged from the pump through the discharge port 9.

Unillustrated oil supply passages can be formed in the drive shaft 1*c* to supply lubricating oil 42 to the inside of the compression chambers 41. In addition, oil 43 from the oil sump 5*b* is sucked into the compression chambers 41 together with intake gas by the pumping action of the scrolls. The oil seals the gaps between adjoining surfaces of the spiral wraps 1*b* and 2*b* and between the ends surfaces of the spiral wraps and the inner surfaces of the base plates 1*a* and 2*a* which confront the end surfaces. By preventing leaks of compressed gas, the oil increases the pumping efficiency of the scrolls. The oil which enters the compression chambers 41 is discharged together with compressed gas into discharge chamber 3*b*, where it separates from the gas and falls back to the bottom of the upper casing 3.

It can be seen that in the present invention, because compressed gas from the compression chambers 41 is simultaneously discharged through two discharge ports 1*d* and 2*d*, the total flow resistance of the two discharge ports is half that of a single discharge port of a conventional scroll-type pump. Therefore, discharge of fluid from the scrolls can take place smoothly, and the efficiency of the pump is increased.

What is claimed is:

1. A scroll-type fluid machine comprising:

a drive scroll having a base plate, a drive shaft which extends from one surface of the base plate, and a spiral wrap which extends from another surface of the base plate;

a driven scroll having a base plate, a spiral wrap which extends from one surface of the base plate and interfits with the spiral wrap of the drive scroll to define a compression chamber, and a driven shaft which extends from another surface of the base plate of the driven scroll;

means for transmitting rotation of the drive scroll to the driven scroll;

a first casing which houses the drive scroll and the driven scroll;

a second casing which adjoins the first casing, the shaft of the drive scroll extending into the second casing;

oil which partially fills the second casing;

a first discharge port which is formed in the base plate of the drive scroll;

a first discharge passage which extends through the drive scroll from the first discharge port to the inside of the second casing above the level of the oil;

a second discharge port which is formed in the base plate of the driven scroll;

a second discharge passage which extends through the driven shaft from the second discharge port to an outer surface of the driven shaft; and a passage which connects the second discharge passage to the inside of the second casing above the level of the oil.

2. A scroll-type fluid machine comprising:

a drive scroll having a base plate, a drive shaft which extends from one surface of the base plate, and a spiral wrap which extends from another surface of the base plate;

a driven scroll having a base plate, a spiral wrap which extends from one surface of the base plate and interfits with the spiral wrap of the drive scroll to define a compression chamber, and a driven shaft which extends from another surface of the base plate of the driven scroll;

means for transmitting rotation of the drive scroll to the driven scroll;

a first casing which houses the drive scroll and the driven scroll;

a second casing which adjoins the first casing, the shaft of the drive scroll extending into the second casing;

oil which partially fills the second casing;

a first discharge port which is formed in the base plate of the drive scroll;

a check valve which is disposed in the first discharge port;

a first discharge passage which extends through the drive scroll from the first discharge port to the inside of the second casing above the level f the oil;

a second discharge port which is formed in the base plate of the driven scroll;

a check valve which is disposed in the second discharge port;

a second discharge passage which extends through the driven shaft from the second discharge port to an outer surface of the driven shaft; and a passage which connects the second discharge passage to the inside of the second casing above the level of the oil.

* * * * *